United States Patent [19]

Darragh et al.

[11] Patent Number: 4,697,633

[45] Date of Patent: Oct. 6, 1987

[54] THERMALLY BALANCED RESTRAINT SYSTEM FOR A HEAT EXCHANGER

[75] Inventors: Charles T. Darragh, San Diego; Edward L. Parsons, Jr., El Cajon, both of Calif.

[73] Assignee: Solar Turbines Incorporated, San Diego, Calif.

[21] Appl. No.: 737,301

[22] Filed: May 22, 1985

[51] Int. Cl.[4] ..... F28F 3/00

[52] U.S. Cl. ..... 165/51; 165/166; 60/39.511

[58] Field of Search ..... 165/51, 166, 167; 60/39.51 R

[56] References Cited

U.S. PATENT DOCUMENTS 2,016,164 10/1935 Williams ..... 165/167 X 4,090,358 5/1978 Young ..... 60/39.51 R 4,331,352 5/1982 Graves ..... 285/226

*Primary Examiner*—Allen M. Ostrager

*Attorney, Agent, or Firm*—Larry G. Cain

[57] ABSTRACT

The restraint systems presently used with existing heat exchangers or recuperators have a thermal growth rate different than the thermal growth rate of the core of the recuperator. The present thermally balanced restraint system overcomes the problem of a different growth rates by utilizing tie rods which are individually made of a plurality of small diameter rods has a thermal growth rate very near that of the core of the heat exchanger. As the plates of the core thermally expand and contract in response to the heat from the engine exhaust, the plurality of small diameter rods also expand and contract at a rate very near that of the core.

26 Claims, 2 Drawing Figures

THERMALLY BALANCED RESTRAINT SYSTEM FOR A HEAT EXCHANGER

DESCRIPTION

TECHNICAL FIELD

This invention relates generally to a heat exchanger and more particularly to the construction of the heat exchanger having a thermally balanced restraint system to carry the loads caused by internal pressure and thermal loads within the heat exchanger.

BACKGROUND ART

Many gas turbine engines use a heat exchanger in the form of a primary surface recuperator to increase the operating efficiency of the engine by extracting heat from the exhaust gas and preheating the intake air. Typically, a recuperator for a gas turbine engine must be capable of operating at temperatures of about 650° C. and internal pressures of approximately 550 kPa under operating conditions involving repeated starting and stopping cycles. In some large turbine engine installations, the recuperator may be 3 meters or longer.

Such recuperators include a core which is commonly constructed from a plurality of stacked side-by-side thin stainless steel sheets. Successive pairs of the sheets are joined at their periphery to form passages called air cells. Compressed discharged air from a compressor of the engine passes through the air cells while the hot exhaust gas flows through the passages formed by the exterior surfaces of each adjacent pair of air cells. The exhaust gas heats the sheets and the intake air from the compressor absorbs the heat from the sheets. Support for the air cells is provided by clamping the stack of air cells, commonly called a core, between two rigid end beams. Such end beams prevent the air cells from "ballooning" due to internal pressure of the intake air. The clamping force heretofore has been provided by either external or internal restraint systems which rigidly interconnect the two end beams.

An example of an external restraint system is disclosed in U.S. Pat. No. 4,090,358 issued to D. Craig Young on May 23, 1978. In such system, the restraining members are located externally of the recuperator. One of the problems with such restraint system is the drastically different thermal response time of the restraint members as compared to the thermal response time of the core. For example, when the engine is started, the exhaust gas and recuperator heat very rapidly causing the core to grow rapidly due to thermal expansion of the components. Since the restraining members are located externally of the recuperator, they are not heated as rapidly as the core and the rate of thermal expansion thereof is much slower than the expansion rate of the core. This thermal growth difference causes a thermal tension load on the restraining members and a compressive load on the recuperator in addition to the load from internal air pressure. These combined loads can exceed the compressive strength of the recuperator causing it to yield to a compressed length. When the recuperator and restraining members reach thermal stability, the compressed recuperator is no longer supported by the restraint system and the recuperator internal structure is subjected to the force caused by the internal air pressure. This overloading of the recuperator structure by the internal air pressure can result in reduced low cycle fatigue life. Low cycle fatigue causes cracking in the air cells adjacent each end of the core allowing air to leak therefrom which thereby reduces the efficiency of the recuperator.

An example of an internal restraint system is disclosed in U.S. Pat. No. 4,331,352 issued to Richard F. Graves on May 25, 1982. That disclosure utilizes a plurality of independent, large diameter tie rods which extend through the exhaust gas flow path and between flanges at opposite ends of the recuperator. That patent recognizes that the tie rods and core experience thermal growth and consequently separate additional devices were provided to accommodate such thermal growth. Such additional devices add to the complexity of constructing the recuperator and add additional cost thereto.

The present invention is directed to overcome one or more of the problems as set forth above.

DISCLOSURE OF THE INVENTION

In one aspect of the present invention, a heat exchanger includes a core, a housing surrounding the core and defining a fluid flow path through the heat exchanger, a pair of end beams located at opposite ends of the core, and means for interconnecting the end beams so that the core is clamped therebetween. The means for interconnecting includes a plurality of tie rods extending through the fluid flow path and having opposite ends connected to the end beams. Each of the tie rods includes a socket adjacent each end and a plurality of small diameter rods extending between and connected to the sockets.

In another aspect of the invention, a gas turbine engine has an exhaust gas pipe, a heat exchanger which includes a core, a housing surrounding the core and defining a fluid flow path through the heat exchanger, a pair of end beams located at opposite ends of the core and means for interconnecting the end beams so that the core is clamped therebetween, said exhaust gas pipe being connected to the fluid flow path of the heat exchanger. The means for interconnecting includes a plurality of tie rods extending through the fluid flow path and has opposite ends connected to the end beams. Each of the tie rods includes a socket adjacent each end and a plurality of small diameter rods extending between and connected to the sockets.

In another aspect of the invention a tie rod is adapted to be used with a heat exchanger which includes a core, a housing surrounding the core and defining a fluid flow path through the heat exchanger and a pair of end beams located at opposite ends of the housing. The tie rod comprises a pair of spaced apart sockets and a plurality of small diameter rods extending between and connected to the sockets. Each of the small diameter rods has a length and a diameter with the length of each small diameter rod being substantially greater than the diameter. A fastener is connected to each socket.

In another aspect of the invention, a heat exchanger includes a core, a housing surrounding the core and defining a fluid flow path through the heat exchanger, a pair of end beams located at opposite ends of the core, and means for interconnecting the end beams so that the core is clamped therebetween. The means for interconnecting includes a plurality of small diameter rods extending through the fluid flow path and having opposite ends connected to the end beams.

The present invention provides a thermally balanced restraint system for a heat exchanger which thermally expands and contracts at the nearly same rate as the core of the heat exchanger. With the rate of thermal expansion and contraction of the core and restraint system being nearly the same, cracking and malfunctioning of the core due to thermal stress and pressure is eliminated.

BEST MODE FOR CARRYING OUT THE INVENTION

Figure 1:
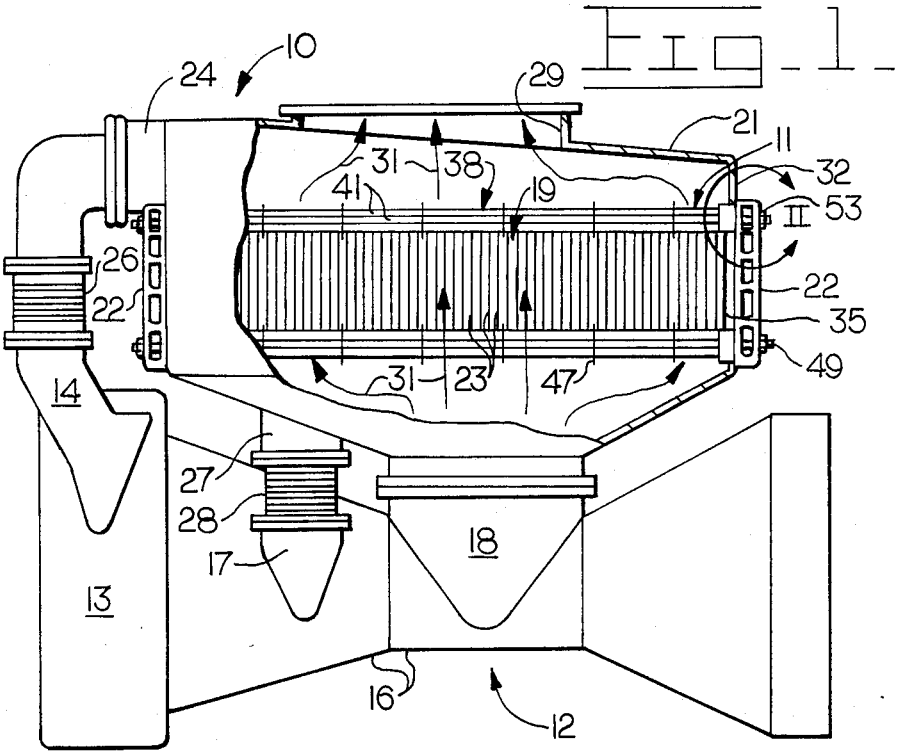
FIG. 1 is a side view of a gas turbine engine having an embodiment of the present invention.

Referring to the drawings, a heat exchanger or recuperator 10 includes a thermally balanced restraint system 11 and is attached to a gas turbine engine 12. The gas turbine engine includes a compressor 13 having a discharge nozzle 14, and a combustion and turbine section 16 having an air intake duct 17 and an exhaust pipe 18.

The recuperator 10 includes a core 19, a housing 21, a pair of end beams 22 and the thermally balanced restraint system 11.

The core 19 includes a plurality of primary surface plates 23 stacked in spaced side-by-side relation to one another. The outer periphery of successive pairs of the plates 23 are joined together in the usual manner to form alternate air flow and exhaust gas passages (not shown) therethrough. An inlet duct 24 is connected to the discharge nozzle 14 of the compressor 13 through a bellows type fitting 26 and to the inlet side of the air flow passages. An outlet duct 27 is connected to the outlet side of the air flow passages of the core and to the intake duct 17 through a bellows type fitting 28.

Figure 2:
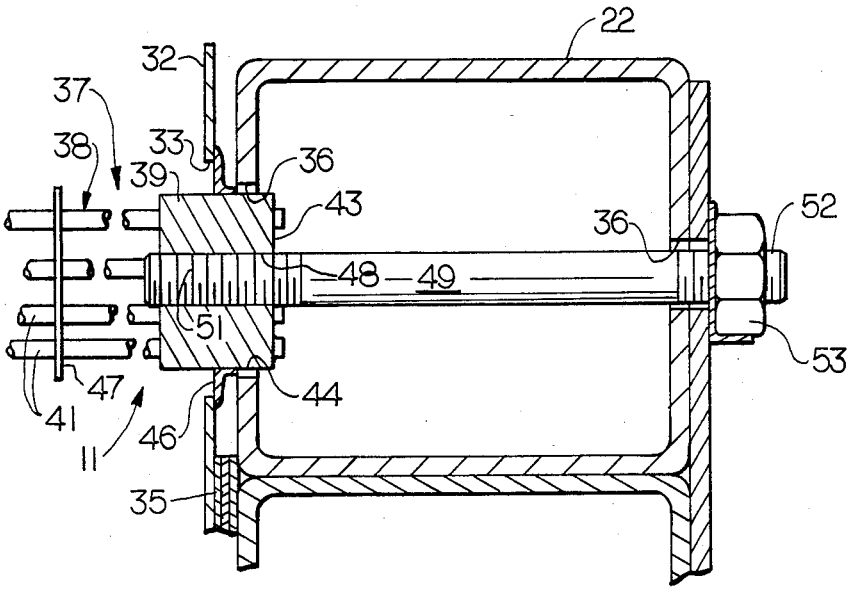
FIG. 2 is an enlarged broken out section view of the area circumscribed within line II of FIG. 1.

The housing 21 is connected to the exhaust pipe 18 of the engine 12 and has an exhaust opening 29 at the opposite side thereof. The housing surrounds the core 19 and defines an exhaust gas flow path represented by the arrows 31. The gas flow path communicates exhaust gas from the exhaust pipe 18 through the exhaust gas passages in the core and to the exhaust opening 29. The housing includes opposite end walls 32 each of which has a plurality of holes therein, one of which are shown at 33 in FIG. 2.

The pair of end beams 22 are located at opposite ends of the core 19 and, in this embodiment, are constructed from a plurality of box beams and plates suitably interconnected as by welding or the like to form a rigid structure. Each end beam has a plurality of holes 36 therein aligned with the holes 33 in the end walls 32 of the housing 21. An insulator 35 is suitably positioned between the end beam 22 and the core 19.

The thermally balanced restraint system 11 defines a means 37 for interconnecting the end beams 22 so that the core 19 is clamped therebetween. The means 37 for interconnecting includes a plurality of rapid thermal response tie rods 38 extending through the exhaust gas flow path 31 with each tie rod having opposite ends connected to the pair of end beams 22. Each of the tie rods 38 includes a pair of spaced apart sockets 39, a plurality of small diameter rods 41 extending between and connected to the sockets 39 and a means 42 for adjustably connecting the sockets 39 to the associated end beams 22. Alternatively, each of the small diameter rods 41 can be individually connected to the associated end beams 22. Each of the sockets has a face 43 and a plurality of through bores 44 therein corresponding in number to the plurality of small diameter rods. The rods extend through the through bores 44 with the ends of the rods extending past the face 43. Each of the rods are fixedly retained therein as by welding or the like. Each of the sockets extend through one of the holes 33 in the end walls 32 and is suitably sealably connected to the end wall by a collar 46. A plurality of spacers 47 are spaced along the length of each tie rod 38 and are suitably connected thereto to prevent vibration of the rods.

The means 42 for adjustably connecting includes a threaded bore 48 in the socket 39, a threaded fastener or stud 49 having a first threaded end portion 51 threaded into the threaded bore 48 and a second threaded end portion 52 extending through the associated hole 36 in the end beam and a nut 53 threaded onto the second threaded end 52 and in abutment with the end beam.

While the thermally balanced restraint system 11 is described in use with a particular type of heat exchanger, such system can be used with other types of heat exchangers or the like in which the rate of thermal response between components thereof must be substantially equal.

INDUSTRIAL APPLICABILITY

In use, the exhaust gas from the engine 12 flows through the exhaust flow path 31 in the direction of the arrows passing through the exhaust gas passages in the core 19 and exits through the exhaust opening 29. The exhaust gas is generally about 650° C. and about ambient pressure. The hot exhaust gas passing through the gas passages in the core heats the plates 23. At the same time, pressurized air being discharged from the compressor 13 at about 550 kPa passes through the fitting 26, the inlet duct 24, and the air flow passages in the core where it picks up heat from the plates. The heated air then passes through the outlet duct 27, fitting 28, and into the combustion and turbine section 16 where it mixes with the fuel to be burned.

The tie rods 38 restrain the pressure forces developed by the compressed air within the core 19 and prevent the individual air cells of the core from ballooning. At the initial assembly of the recuperator 10, the nuts 53 are tightened to pretension the tie rods 38 and place a predetermined clamping force on the core.

Since the plates 23 and other components of the core 19 are constructed of thin metal, the core heats up very quickly and thermally grows very rapidly. However, since the tie rods 38 are constructed from several small diameter rods 41 and are also located in the exhaust flow path 31, the exhaust gas circulates around the small diameter rods causing them to also heat up very quickly so that the tie rods also thermally grow very rapidly.

The size and material of the small diameter rods 41 making up the tie rods 38 is specifically selected to have a thermal growth characteristic which closely matches that of the core 19 so that the clamping force remains within preselected limits during the heat up and operating cycles. The small diameter rods in this embodiment are about 0.63 centimeters in diameter and are made of Inconel 718 steel. The diameter was selected so that the rate of temperature rise of the rods 41 substantially parallels the rate of temperature rise of the core 19. Since the coefficient of thermal expansion of the Inconel 718 rods is less than that of the stainless steel core, the clamping force exerted on the core by the rods will increase slightly. However, the clamping force will remain well below the compression strength of the stainless steel and the increase in the clamping force has no deletorious effect on the core. Inconel 718 steel was selected for the material because it has excellent high temperature strength and complete freedom from creep in the design temperature range. The number of small diameter rods 41 making up each tie rod 38 is selected to provide the preselected clamping force without yielding the tie rods.

In view of the foregoing, it is readily apparent that the structure of the present invention provides an improved thermally balanced restraint system which eliminates the problem of slow thermal response of the previous restraint systems relative to the core and end beam design. By utilizing the rapid thermal response tie rods constructed from a plurality of small diameter rods, the core and the tie rods thermally expand at substantially the same rate. Thus, the thermally balanced restraint system drastically reduces transient thermal stresses over the known external restraint system and thus increases low cycle fatigue life to well over 5,000 start and stop cycles.

Other aspects, objects and advantages will become apparent from a study of the specification, drawings and appended claims.

What is claimed:

1. In a heat exchanger including a core, a housing surrounding the core and defining a hot fluid flow path through the heat exchanger, a pair of end beams located at opposite ends of the core, and means for interconnecting the end beams so that the core is clamped therebetween, the improvement comprising:

said means for interconnecting including a plurality of tie rods extending through the hot fluid flow path and having opposite ends connected to the end beams, each of said tie rods including a socket adjacent each end and a plurality of small diameter rods extending between and connected to the sockets .

2. The heat exchanger of claim 1 wherein the tie rods have a thermal expansion characteristic which closely matches the thermal expansion characteristic of the core.

3. The heat exchanger of claim 2 wherein said core is constructed substantially from stainless steel and the small diameter rods are made from Inconel 718 steel.

4. The heat exchanger of claim 2 wherein each of said small diameter rods is about 0.63 centimeters in diameter.

5. The heat exchanger of claim 1 wherein each socket has a plurality of through bores therein corresponding in number to the plurality of small diameter rods, said rods extending through said bores in the socket.

6. The heat exchanger of claim 5 wherein each socket has a face, the ends of the plurality of rods extending through the bores past the face and being fixedly retained therein.

7. The heat exchanger of claim 1 wherein said means for interconnecting includes means for adjustably connecting each of the sockets to the associated end beam.

8. The heat exchanger of claim 7 wherein said end beams have a hole therein, said means for adjustably connecting includes a threaded bore in the socket, a stud having a first threaded end portion threaded into the threaded bore in the socket and a second threaded end portion extending through the hole in the end beam, and a nut threaded onto the second threaded end portion of the stud.

9. The heat exchanger of claim 1 wherein each of said tie rods further includes a plurality of spacers spaced along the length of the plurality of small diameter rods.

10. The heat exchanger of claim 1 wherein each of said sockets is sealingly connected to the housing.

11. A gas turbine engine having an exhaust pipe, a heat exchanger including a core, a housing surrounding the core and defining a fluid flow path through the heat exchanger, a pair of end beams located at opposite ends of the housing and means for interconnecting the end beams so that the core is clamped therebetween, said exhaust pipe being connected to the fluid flow path of the heat exchanger, the improvement comprising:

said means for interconnecting including a plurality of tie rods extending through the fluid flow path and having opposite ends connected to the end beams, each of said tie rods including a socket adjacent each end and a plurality of small diameter rods extending between and connected to the sockets.

12. The gas turbine engine of claim 11 wherein the tie rods have a thermal expansion characteristic which closely matches the thermal expansion characteristic of the core.

13. The gas turbine engine of claim 12 wherein said core is constructed substantially from stainless steel and the small diameter rods are made from Inconel 718 steel.

14. The gas turbine engine of claim 12 wherein each of said small diameter rods is about 0.63 centimeters in diameter.

15. The gas turbine engine of claim 11 wherein each socket has a plurality of through bores therein corresponding in number to the plurality of small diameter rods, said rods extending through said bores in the socket and fixedly retained therein.

16. The gas turbine engine of claim 15 wherein said means for interconnecting includes means for adjustably connecting each of the sockets to the associated end beam.

17. The gas turbine engine of claim 16 wherein said end beams have a hole therein, said means for adjustably connecting includes a threaded bore in the socket, a stud having a first threaded end portion threaded into the threaded bore in the socket and a second threaded end portion extending through the hole in the end beam, and a nut threaded onto the second threaded end portion of the stud.

18. The gas turbine engine of claim 11 wherein each of said tie rods further includes a plurality of spacers spaced along the length of the plurality of small diameter rods.

19. A tie rod adapted to be used with a heat exchanger including a core, a housing surrounding the core and defining a fluid flow path through the heat exchanger, and a pair of end beams located at opposite ends of the housing, said tie rod comprising:

a pair of spaced apart sockets;

a plurality of small diameter rods extending between and connected to the sockets, each of said small diameter rods having a length and a diameter, the length of each small diameter rod being substantially greater than the diameter; and a fastener connected to each socket.

20. The tie rod of claim 19 wherein each of said sockets has a plurality of bores therein through which the rods extend.

21. The tie rod of claim 19 wherein each of said sockets has a threaded bore threin and said fastener includes a stud having a first threaded end portion threaded into the threaded bore in the socket and a second threaded end portion, and a nut threadable onto the second threaded end portion of the stud.

22. The tie rod of claim 19 further including a plurality of spacers equally spaced along the length of the plurality of small diameter rods and connected thereto.

23. In a heat exchanger including a core , a housing surrounding the core and defining a hot fluid flow path through the heat exchanger, a pair of end beams located at opposite ends of the core, and a plurality of means for interconnecting the end beams so that the core is clamped therebetween, the improvement comprising: each of said means for interconnecting including a plurality of small diameter rods extending through the hot fluid flow path and having opposite ends connected to the end beams.

24. The heat exchanger of claim 23 wherein the small diameter rods have a thermal expansion characteristic which closely matches the thermal expansion characteristic of the core.

25. The heat exchanger of claim 24 wherein said core is constructed substantially from stainless steel and the small diameter rods are made from Inconel 718 steel.

26. The heat exchanger of claim 24 wherein each of said small diameter rods is about 0.63 centimeters in diameter.

* * * * *